US009227831B2

(12) United States Patent
Bates

(10) Patent No.: US 9,227,831 B2
(45) Date of Patent: Jan. 5, 2016

(54) SADDLE WITH ADJUSTABLE BLOCKS

(71) Applicant: Hammersmith Nominees Pty Ltd, West Perth (AU)

(72) Inventor: Ronald Gordon Bates, Dalkeith (AU)

(73) Assignee: Hammersmith Nominees Pty Ltd, West Perth (AU)

( * ) Notice: Subject to any disclaimer, the term of this patent is extended or adjusted under 35 U.S.C. 154(b) by 110 days.

(21) Appl. No.: 14/051,991

(22) Filed: Oct. 11, 2013

(65) Prior Publication Data

US 2014/0102052 A1 Apr. 17, 2014

(30) Foreign Application Priority Data

Oct. 11, 2012 (AU) ..... 2012904448

(51) Int. Cl.
*B68C 1/04* (2006.01)
*B68C 1/02* (2006.01)

(52) U.S. Cl.
CPC .... *B68C 1/04* (2013.01); *B68C 1/02* (2013.01)

(58) Field of Classification Search
CPC ..... B68C 1/02; B68C 1/20; B68C 2001/022; B68C 2001/044; B68C 1/00
USPC ..... 54/44.1, 44.3, 44.5, 44.7, 45.1
See application file for complete search history.

(56) References Cited

U.S. PATENT DOCUMENTS

| | | | | | |
|---|---|---|---|---|---|
| 4,033,097 | A * | 7/1977 | Petit | 54/44.6 |
| 4,414,791 | A * | 11/1983 | Freeze | 54/44.3 |
| 5,383,328 | A * | 1/1995 | Brown | 54/44.3 |
| 5,740,665 | A | 4/1998 | Belton | |
| 7,562,514 | B2 | 7/2009 | Bates | |
| 8,261,519 | B2 * | 9/2012 | Woods | 54/44.1 |
| 2002/0189211 | A1 * | 12/2002 | DeCosemo | 54/44.1 |
| 2006/0080946 | A1 * | 4/2006 | DeCosemo | 54/44.1 |
| 2011/0271651 | A1 * | 11/2011 | Morgan | 54/44.1 |
| 2013/0067871 | A1 * | 3/2013 | Morgan | 54/44.1 |
| 2013/0199136 | A1 * | 8/2013 | Woods | 54/44.1 |

FOREIGN PATENT DOCUMENTS

| | | | | |
|---|---|---|---|---|
| DE | 19924383 | A1 * | 11/2000 | B68C 1/02 |
| DE | 20 2006 006 278 | U1 | 1/2007 | |
| DE | 102012014165 | A * | 10/2013 | B68C 1/02 |
| NL | 8901537 | A * | 1/1991 | B68C 1/02 |

* cited by examiner

*Primary Examiner* — Rob Swiatek
*Assistant Examiner* — Danielle Clerkley
(74) *Attorney, Agent, or Firm* — Seed IP Law Group PLLC

(57) ABSTRACT

An equestrian saddle having flaps, and a block mounted to each flap for engagement by the leg of the rider, the block being mounted to the flap by a mounting system which permits the position of the block on the flap to be adjusted and which retains the block in its selected position on the flap by a clamping action between the block and the flap.

5 Claims, 9 Drawing Sheets

SADDLE WITH ADJUSTABLE BLOCKS

BACKGROUND

1. Technical Field

The present invention relates to a saddle for equestrian use and more particularly it relates to a design of saddle flap which allows the contours of the flap easily to be adjusted.

2. Description of the Related Art

Conventionally, an equestrian saddle comprises a saddle flap extending downwardly from each side of the seat and overlying a saddle panel at that side. The outer surface of the flap may be profiled with padding in its forward part to overlie a block fixed to the panel beneath the flap and which contours the forward end portion of the flap for engagement by the leg of the rider. Ideally, a different contouring is needed for different uses of the saddle to provide grip by the part of the rider's leg appropriate to that usage. Accordingly, for example, the size and/or position and/or shape of a block of a saddle primarily intended for use in dressage will be different to that in a saddle primarily intended for use in jumping and both will be different to the block, if provided, in a general purpose saddle. Conventionally, this means that a different saddle may be produced for different primary uses.

U.S. Pat. No. 5,740,665 proposes a design of saddle flap in which the contour at its forward end portion can be modified in order to change the saddle to suit a different primary use. In this previously proposed saddle, the flap is provided with a removable forward part which is contoured by means of a block to suit a specific usage, a range of different forward parts being provided each with a different contour with the user selecting whichever forward part best suits the intended use at that time and mounting that to the remainder of the flap panel. While this proposal provides a saddle which can be adjusted by the user to suit a number of different primary uses nevertheless it is quite an expensive solution as a range of different replaceable flap parts must be acquired and, moreover, it is not really practical for a saddle manufacturer to provide more than a small number of different configurations of contouring.

BRIEF SUMMARY

According to the present invention there is provided an equestrian saddle having flaps, and a block mounted to each flap for engagement by the leg of the rider, the block being mounted to the flap by a mounting system which permits the position of the block on the flap to be adjusted and which retains the block in its selected position on the flap by a clamping action between the block and the flap.

BRIEF DESCRIPTION OF THE DRAWINGS

An embodiment of the invention will now be described by way of example only with reference to the accompanying representations in which.

DETAILED DESCRIPTION

The representations show a saddle flap 2 in accordance with a preferred embodiment of the invention. The saddle flap 2 is attached to the seat of the saddle at one side to overlie the saddle panel at that side. A flap of corresponding, but mirror image, form to that shown is attached to the seat at the other side of the saddle. A block 4 for engagement by the leg of the rider is adjustably mounted to the outer side of the flap. The adjustable mounting system which will be described in detail shortly also enables the block to be removed for possible replacement by a block of different size and/or shape.

Figure 7:
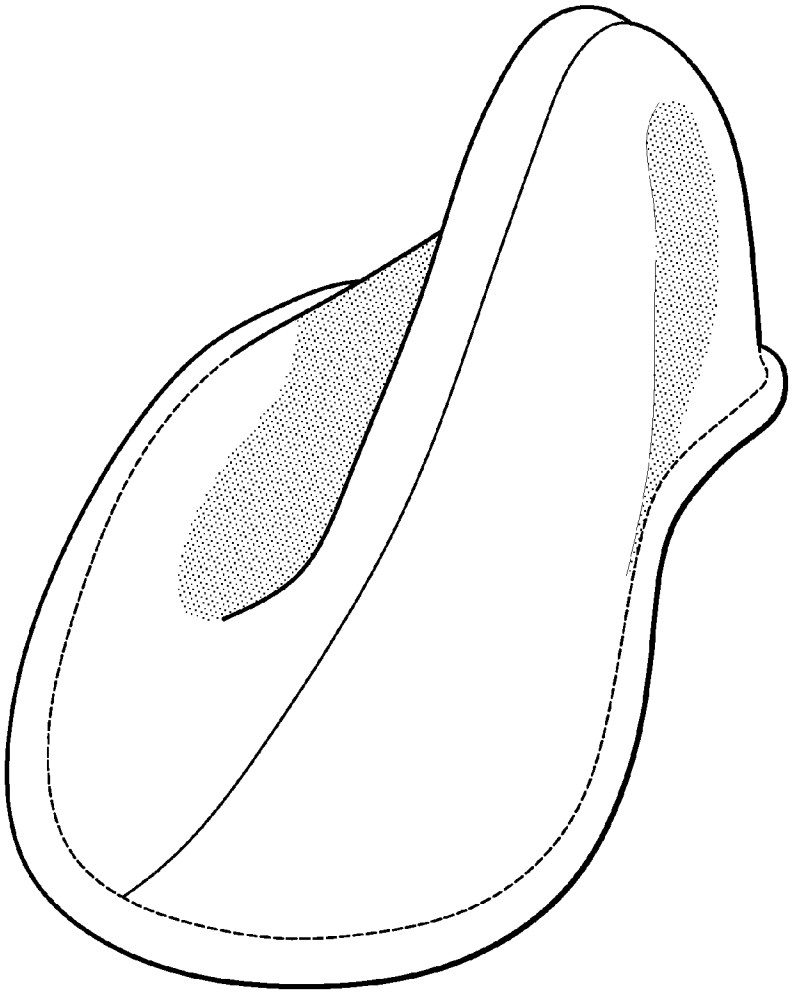
FIG. 7 is a view showing the block removed from the flap.

The block 4 which is shown in FIG. 7 is formed with a rigid or semi-rigid core which may be covered at least on its rearwardly facing surface with a layer of a resiliently compressible material such as an open cell plastics foam, with the block being enclosed within an outer covering to match the exterior of the saddle. This construction of the block provides a cushioning effect for the leg of the rider when applied against the rear face of the block. Advantageously, the rear face of the block is contoured into concave shape in the manner described in our U.S. Pat. No. 7,562,514 so as to better locate the leg of the rider. While this is particularly beneficial in a saddle being used for dressage, it is also of benefit in saddles for other uses. It is however to be understood that the foam layer which provides the cushioning effect is not essential and may be omitted as the concave shape enables the thigh of the rider to comfortably rest against it.

Figure 3:
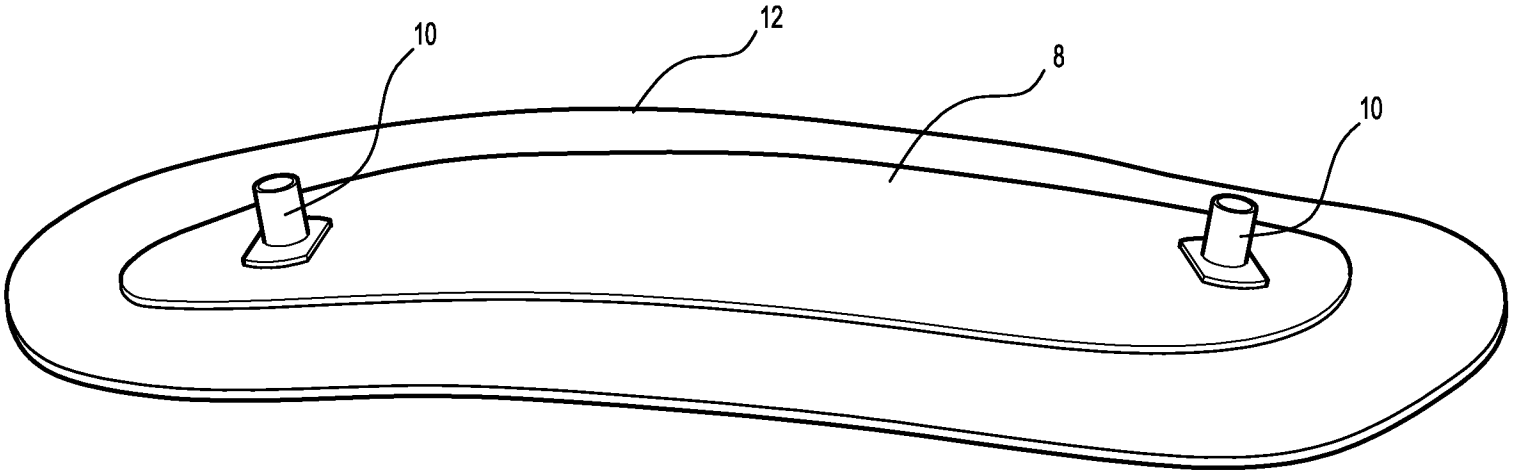
FIG. 3 is a view of a substantially rigid clamping plate within the base of the block.

A substantially rigid plate 8, preferably of metal (see FIG. 3), is incorporated within the base of the block 4 and includes internally-threaded sleeves 10 on its inner surface. The plate 8 is covered by an external covering 12 which forms the base surface of the block and is apertured to permit passage of clamping screws 14 into the threaded sleeves.

Figure 4:
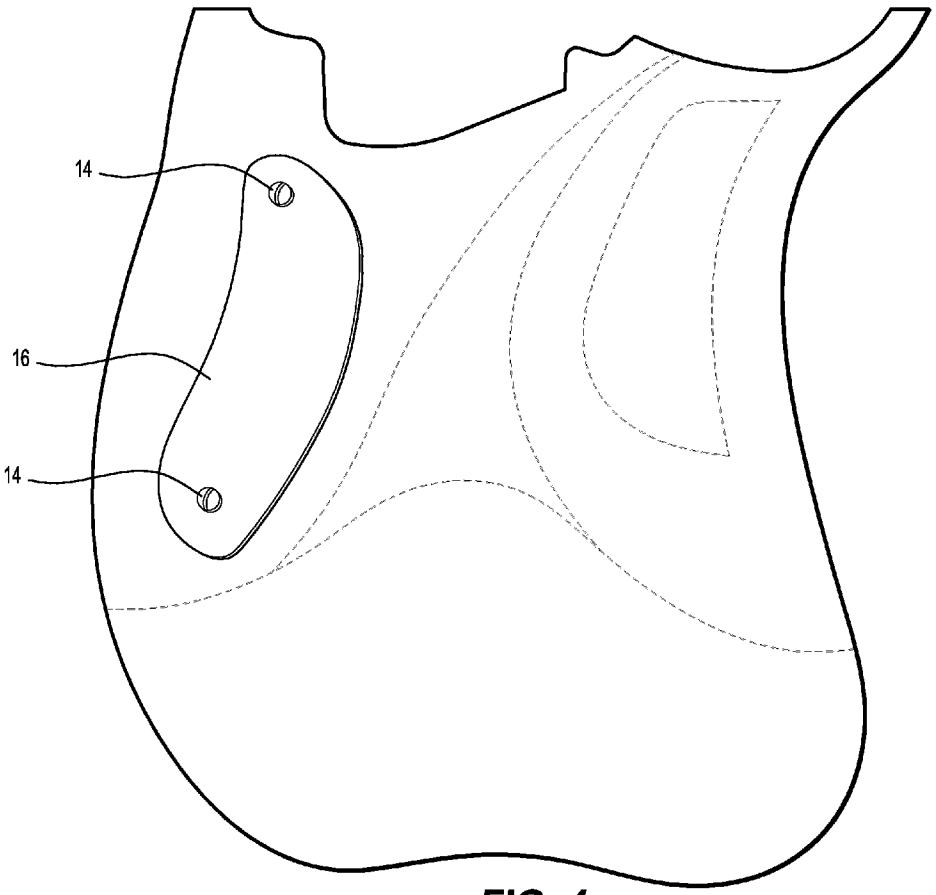
FIG. 4 is a view of the inner side of the flap.

A rigid plate 16 (see FIG. 4), likewise preferably of metal is mounted at the inner side of the flap and carries the clamping screws 14 which pass through apertures in the flap into engagement within the threaded sleeves 10 in the plate 8 in the base of the block. When the screws 14 are tightened the flap is clamped tightly between the two plates 8, 16 thereby securing the block firmly to the flap.

Figure 1:
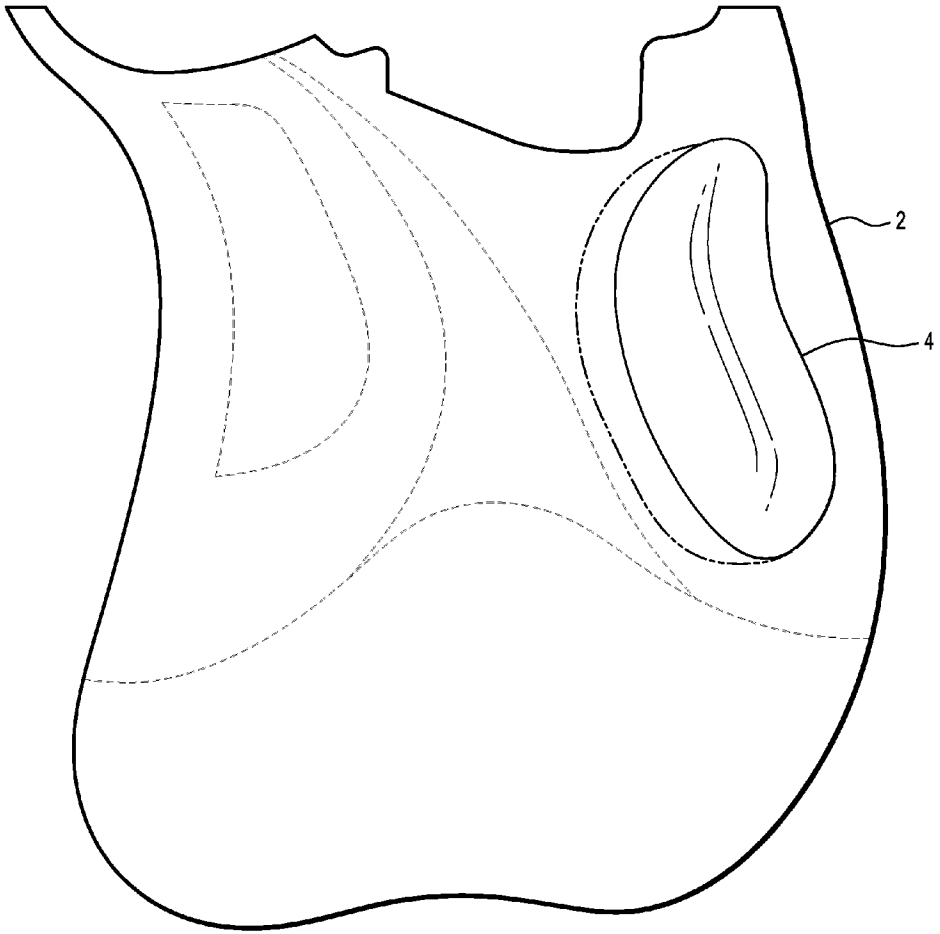
FIG. 1 shows a saddle flap of a saddle in accordance with a preferred embodiment, an adjustable block on the saddle flap being shown in a forward adjusted position.
Figure 2:
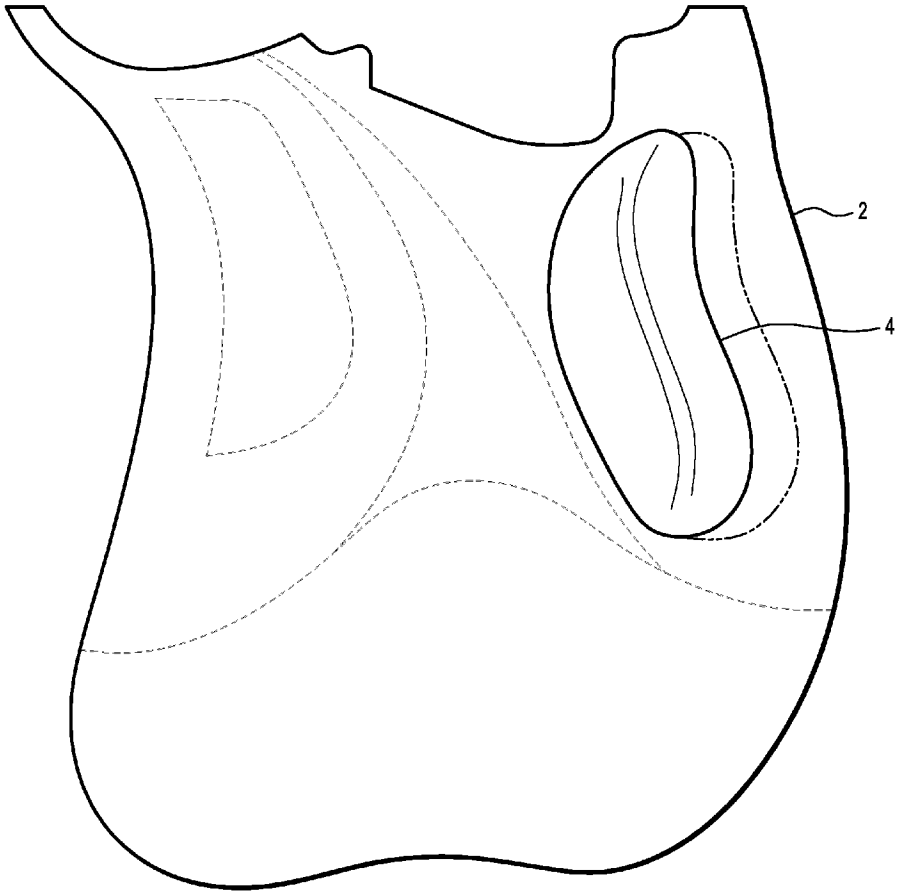
FIG. 2 is a view similar to FIG. 1 but showing the block in a rear adjusted position.
Figure 5:
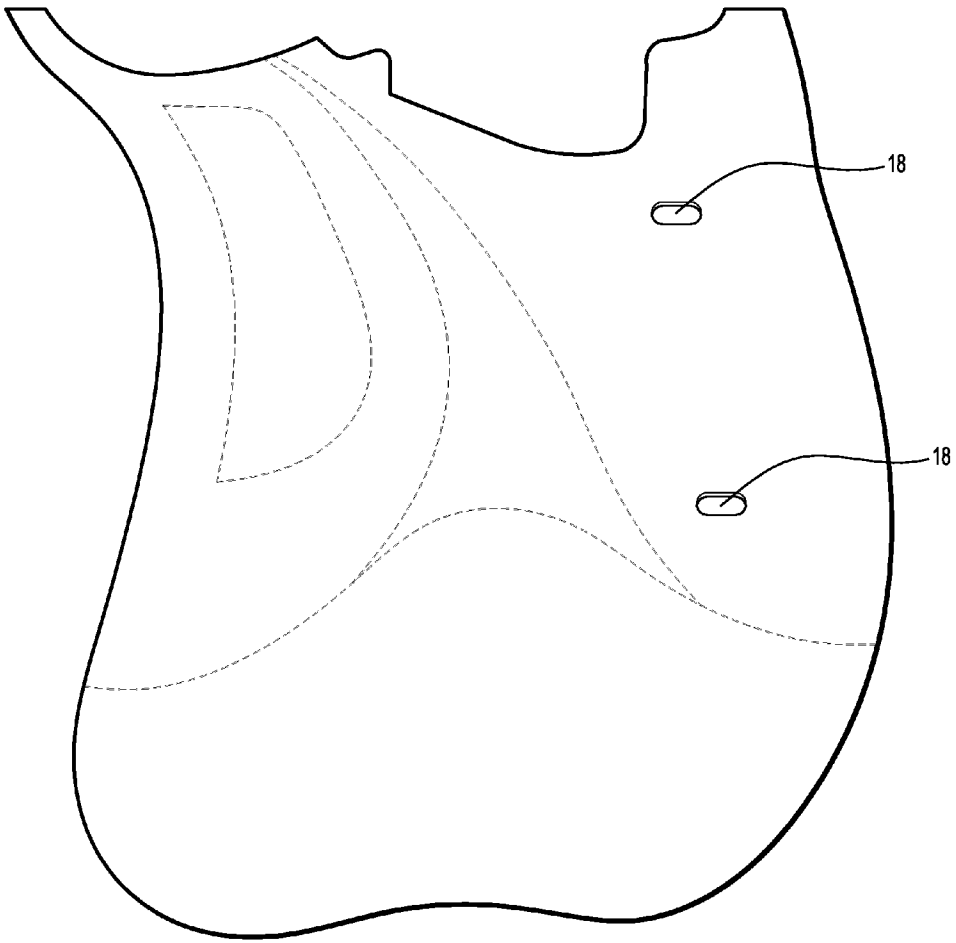
FIG. 5 shows the saddle flap with the block removed to show elongate apertures within the flap to achieve the required adjustment.

With reference to FIG. 5, the apertures 18 in the saddle flap for passage of the screws 14 are of a size greater than the shank diameter of the screws to permit adjustment of the position of the block on the flap by lateral movement of the screws within the apertures. In the preferred embodiment, the apertures 18 are elongate in a forward/rear direction to permit adjustment of the position of the saddle block on the flap in a forward/rear direction. FIG. 1 shows the block in its forwardmost position of adjustment and FIG. 2 shows the block in its rearmost position of adjustment and it will be appreciated that the block can assume any intermediate position between these two positions. Although the apertures could also be configured to permit vertical adjustment if required, the forward/rear adjustment is the primary adjustment which will normally be required.

Figure 6:
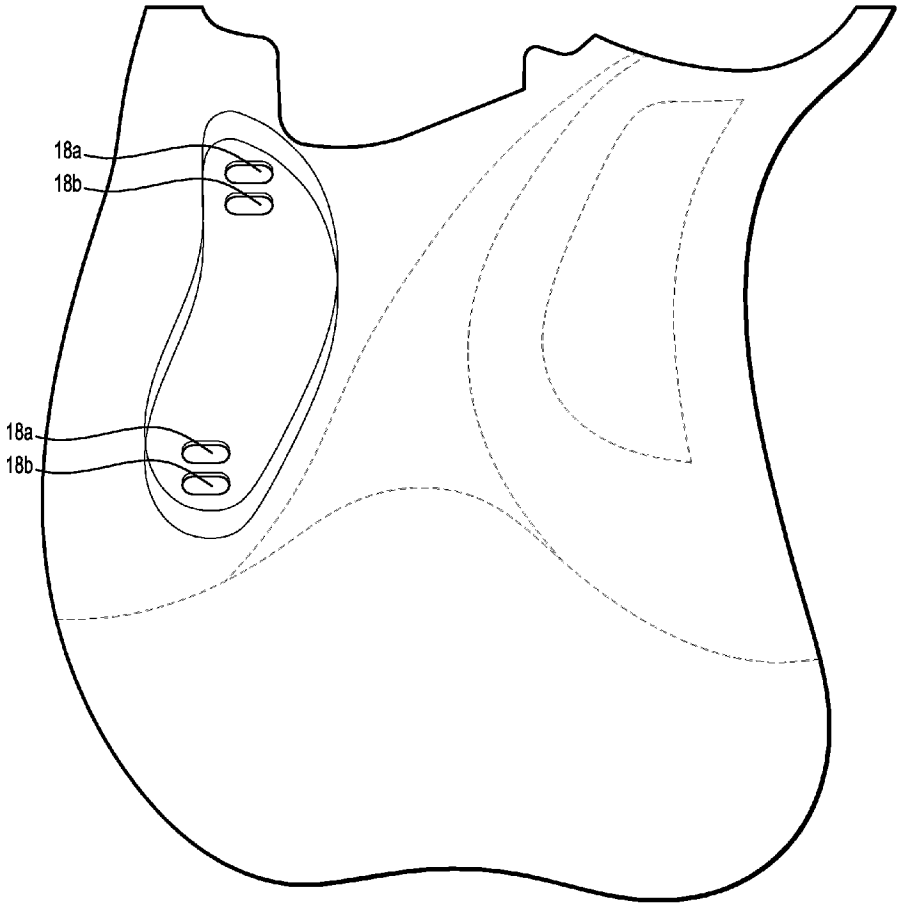
FIG. 6 is a view similar to FIG. 5 of a modified form of flap with two sets of apertures to provide a greater range of adjustment.

FIG. 6 shows a modification with two sets of apertures 18*a*, 18*b* to provide the possibility of positioning the block in a selected one of the two vertical positions on the flap depending on which set of apertures is used. These apertures are also shaped to allow the possibility of adjustment of the inclination of the block.

Figure 8:
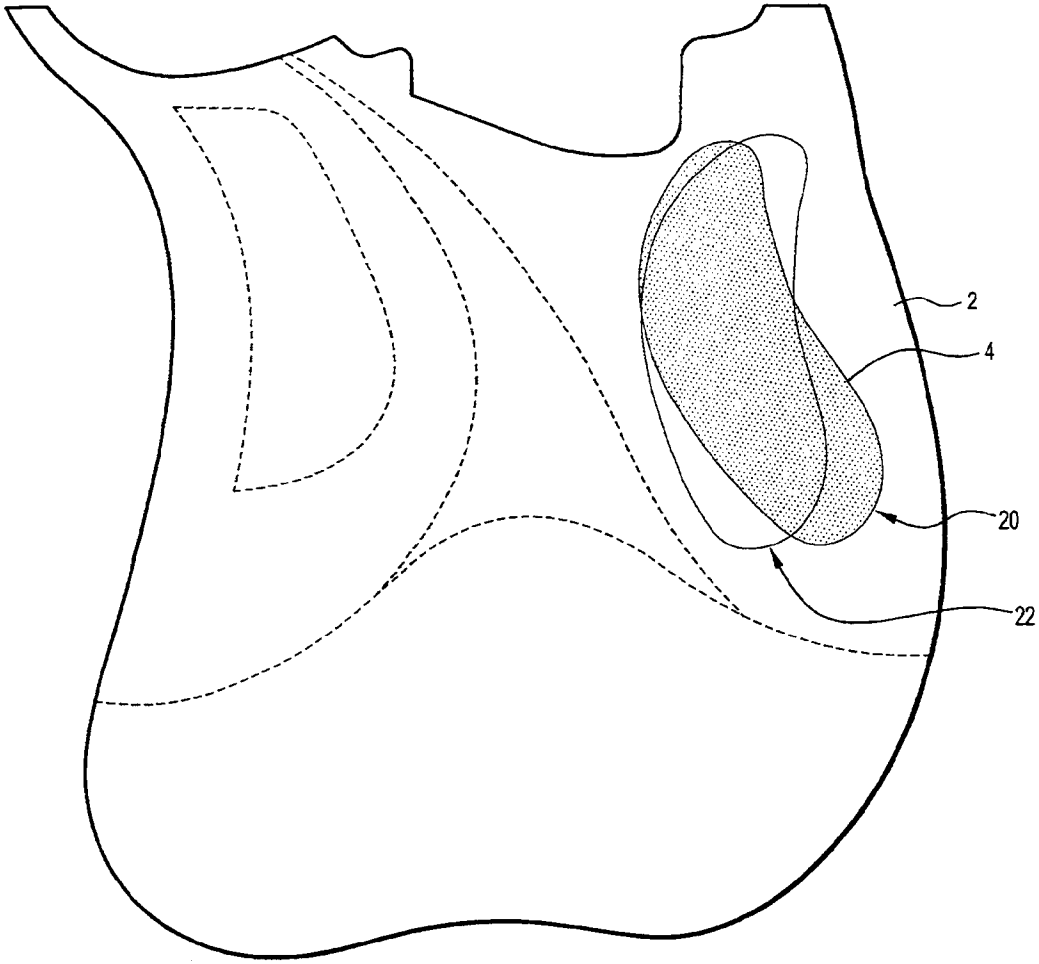
FIG. 8 shows the saddle flap of FIG. 1, diagrammatically depicting pivotal adjustment of the block on the saddle flap.
Figure 9:
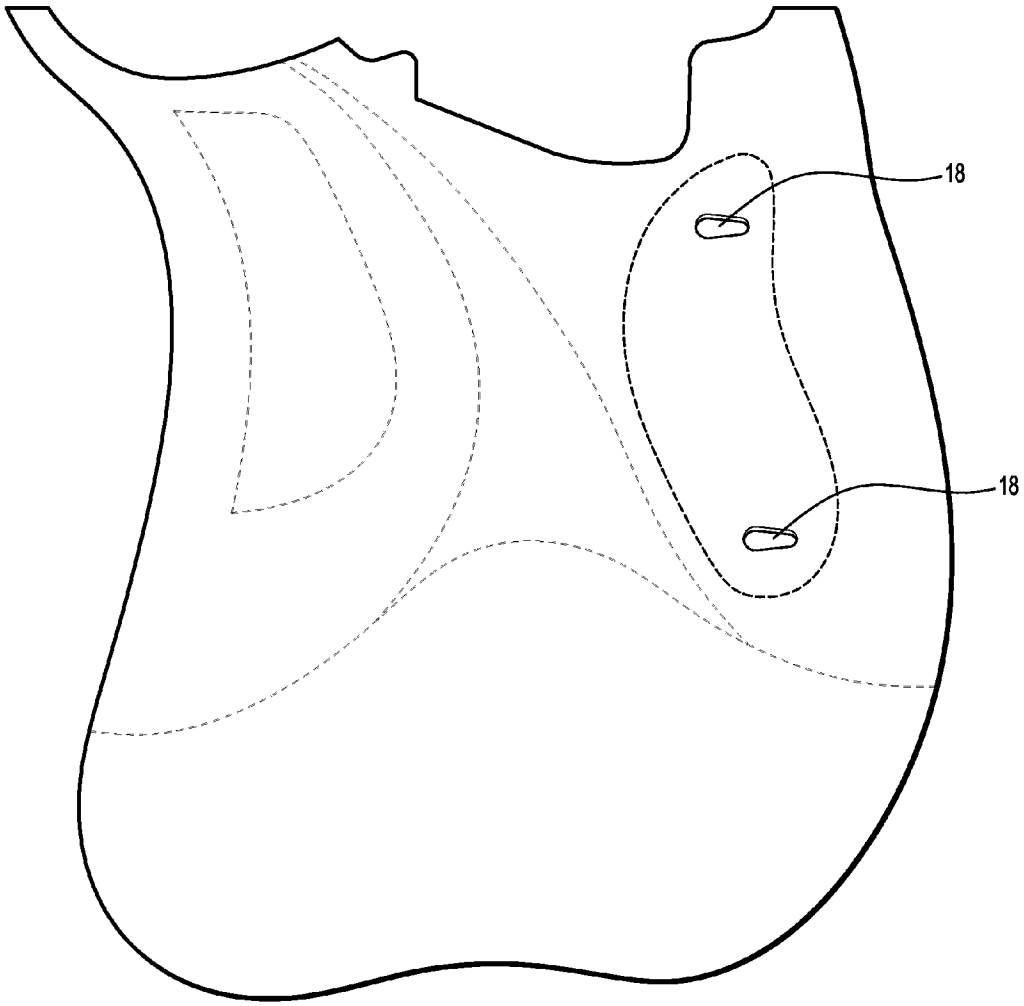
FIG. 9 shows in detail alternative shapes of the apertures formed in the flap to achieve adjustability of the block position relative to the flap.

With reference to FIGS. 8 and 9, the apertures 18 may be in the form of specially shaped slots to allow the block 4 to be angled over a substantial range to mirror the directional angle of the rider's leg, dictated by the length of leg/stirrup and individual riding position. In particular the top of the block 4 can be pivoted about a pivot point at the bottom of the block, or the bottom of the block can be pivoted about a pivot point at the top of the block, between forward and rearward positions. By appropriately configuring the angular extent of the slots, an angular range of adjustment of up to about 40° can be achieved and this dramatically changes the angle of the block 4 against the rider's leg. As shown in FIG. 8, the block 4 may be angled by pivoting the block 4 between a forward ("standard") angle 20 and a rearward angle 22 toward the rider's leg. The block 4 could also be pivoted forward from the "standard" angle 20 away from the rider's leg.

FIG. 9 shows the special shaping of the apertures with a wider rearward end and a narrower forward end, in a generally teardrop shape 18. This shape is of particular benefit in enabling the angle of the block 4 to be adjusted without allowing any substantial change in the height of the block on the flap. This may be understood by pivoting the block about its lower end with the associated screw within, and located by, the narrower forward end of the lower aperture 18 and alternatively by pivoting the block about its upper end with the associated screw within, and located by, the narrower forward end of the upper aperture, in each case the width of the aperture at its forward end being substantially equivalent to the shank diameter of the associated screw. Even with a degree of backwards adjustment, no substantial height change will occur. This facility for adjustment, particularly angular adjustment, without any substantial height change is significant because it facilitates uniformity of setting of the blocks at the two sides of the saddle. However, in an alternative example, the apertures 18 may have other shapes such as, for example, a simple straight slot shape, with the loss of some of the benefits afforded by the teardrop shape.

The size of the base of the block in relation to the size of the apertures in all preferred embodiments is such that in any adjusted position of the block the entirety of the apertures will be concealed beneath the base of the block so that no part of the adjustment system is visible from the exterior of the saddle and therefore does not detract from the aesthetic appearance of the saddle.

A range of different sized/shaped blocks may be provided to enable a greater range of possible set-ups for the saddle in the zone engaged by the legs of the rider. For some uses it may even be preferred to remove the block so that the outer surface of the flap is substantially uncontoured.

The embodiment has been described by way of example only and modifications are possible within the scope of the invention.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavor to which this specification relates.

In the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An equestrian saddle having flaps, and a block mounted to each flap for engagement by a leg of a rider, the block being mounted to the flap by a mounting system which permits the position of the block on the flap to be adjusted and which retains the block in its selected position on the flap by a clamping action between the block and the flap, wherein the mounting system for each block on its respective flap comprises threaded fasteners extending from a base of the block through respective apertures in the flap, the apertures being enlarged in relation to a shank diameter of the threaded fasteners to permit the adjustment of the block by movement of the fasteners within the apertures, the apertures being elongate slots and the block being movable and selectively fastenable to the flap at every location along the length of the slots by securing the threaded fasteners at selected locations along the length of the slots, the adjustment permitted by the enlarged apertures including movement between a forward and rear position and intermediate positions therebetween and adjustment of the angular orientation of the block relative to the flap.

2. A saddle according to claim 1, wherein the threaded fasteners are screws extending through the apertures into the base of the block.

3. A saddle according to claim 2, wherein the base of the block includes a first substantially rigid plate and the screws extend through a second substantially rigid plate at the inner side of the flap into the first plate in the base of the block whereby tightening of the screws causes the flap to be clamped between the first and second plates.

4. A saddle according to claim 3, wherein the size of each aperture is such that in all possible adjusted positions of the block the apertures are concealed beneath the base of the block.

5. A saddle according to claim 4, wherein each of the apertures is in the form of a slot having a wide end and a narrow end.

* * * * *